US005169352A

United States Patent [19]

Petersen

[11] Patent Number: 5,169,352

[45] Date of Patent: Dec. 8, 1992

[54] SYSTEM OF STRUCTURAL FORM BODIES

[75] Inventor: Ole F. Petersen, Mogenstrup, Denmark

[73] Assignee: Ole Friis Petersen ApS, Copenhagen, Denmark

[21] Appl. No.: 720,480

[22] PCT Filed: Mar. 9, 1990

[86] PCT No.: PCT/DK90/00065

§ 371 Date: Jul. 9, 1991

§ 102(e) Date: Jul. 9, 1991

[87] PCT Pub. No.: WO91/13663

PCT Pub. Date: Sep. 19, 1991

[51] Int. Cl.[5] ..... A63H 33/04; A63H 33/08; E04B 5/04

[52] U.S. Cl. ..... 446/85; 446/124; 446/125; 446/117; 52/DIG. 10; 52/608; 52/609

[58] Field of Search ..... 446/85, 124, 125, 117, 446/487, 488, 901; 52/DIG. 10, DIG. 13, 608, 609

[56] References Cited

U.S. PATENT DOCUMENTS

| | | | |
|---|---|---|---|
| 1,129,281 | 2/1915 | Dulgeroff | 446/125 X |
| 1,292,188 | 1/1919 | Wheeler | 446/85 |
| 1,349,767 | 8/1920 | Ivory | 433/159 |
| 1,997,022 | 4/1935 | Stalker | 446/488 |
| 2,440,836 | 5/1948 | Turngren . | |
| 3,461,574 | 8/1969 | Larsen et al. | 52/DIG. 10 X |
| 3,787,996 | 1/1974 | Smith et al. . | |
| 4,051,621 | 10/1977 | Hogan . | |
| 4,063,725 | 12/1977 | Snyder | 446/85 X |
| 4,259,821 | 4/1981 | Bash | 52/DIG. 10 X |
| 4,676,507 | 6/1987 | Patterson | 446/125 X |
| 4,778,184 | 10/1988 | Fleischer | 446/487 X |
| 4,778,392 | 10/1988 | Mitchell | 446/488 X |

FOREIGN PATENT DOCUMENTS

| | | | |
|---|---|---|---|
| 601533 | 8/1934 | Fed. Rep. of Germany . | |
| 1907044 | 2/1969 | Fed. Rep. of Germany . | |
| 2207676 | 8/1973 | Fed. Rep. of Germany . | |
| 3323349 | 1/1984 | Fed. Rep. of Germany | 446/85 |
| 944770 | 4/1949 | France | 446/85 |
| 1349767 | 11/1987 | U.S.S.R. . | |
| 396512 | 8/1933 | United Kingdom | 446/85 |

OTHER PUBLICATIONS

Abstract, SU 1349767A, Health; Amusement-p. 3, Week 8822, "Three-dimensional shaped paper tape articles formation involves forming ring-shaped supporting surface in first stage . . . ".

*Primary Examiner*—D. Neal Muir

*Attorney, Agent, or Firm*—Wegner, Cantor, Mueller & Player

[57] ABSTRACT

A system of form bodies for use as a toy building blocks, decorative objects, in particular for display use, furniture structures, sculptural building components etc., wherein each form body has the shape of a polyhedron, in which polygonal side faces with each other form polyhedral outward extending protuberances and/or polyhedral inward extending notches for the assembling of differently shaped bodies into spatial structures. In a first group of form bodies each form body is shaped on the basis of a cube and the protuberances and/or notches of the form body are shaped on the basis of a subbody of a cuve and with a shape like a pyramid with a square base, two of the side faces being perpendicular to the base at adajcent sides thereof and each of them has the form of an isosceles right triangle. In a second and third group form bodies are formed on the basis of a prism with a base as an equilateral triangle or an isosceles right triangle, respectively, having a side length or a cathetus length, respectively, corresponding to the length of a side of the cube used as the basic body of the first group.

17 Claims, 5 Drawing Sheets

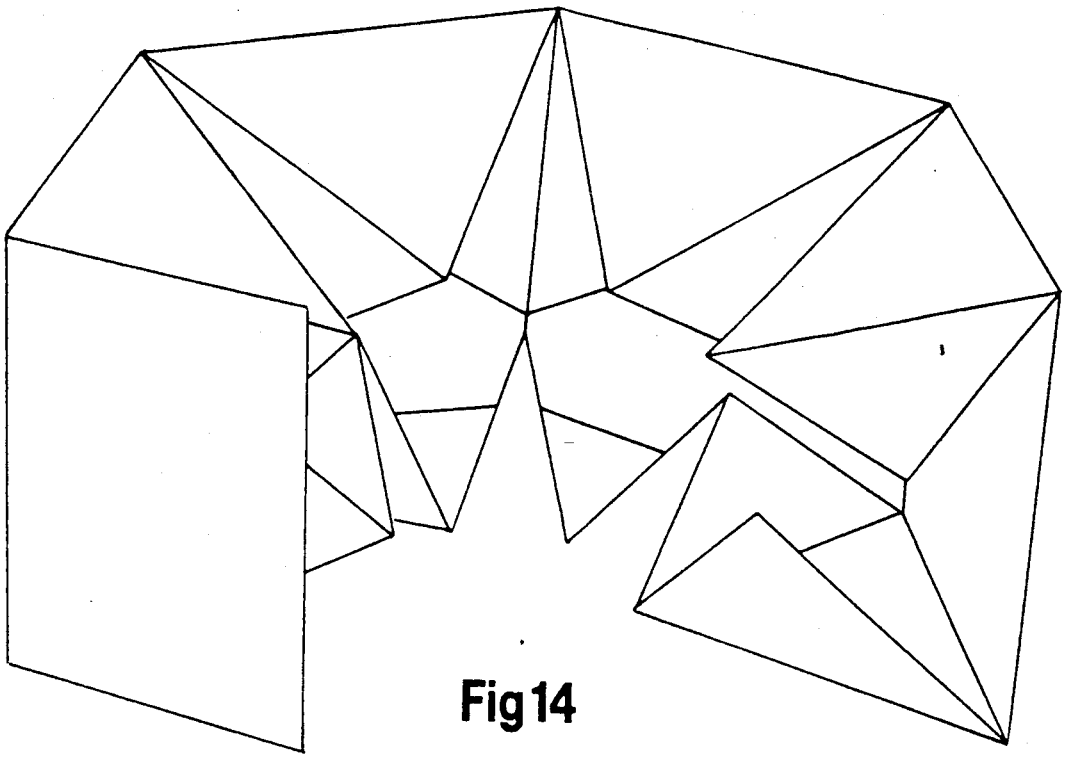
Fig 14
Fig 15
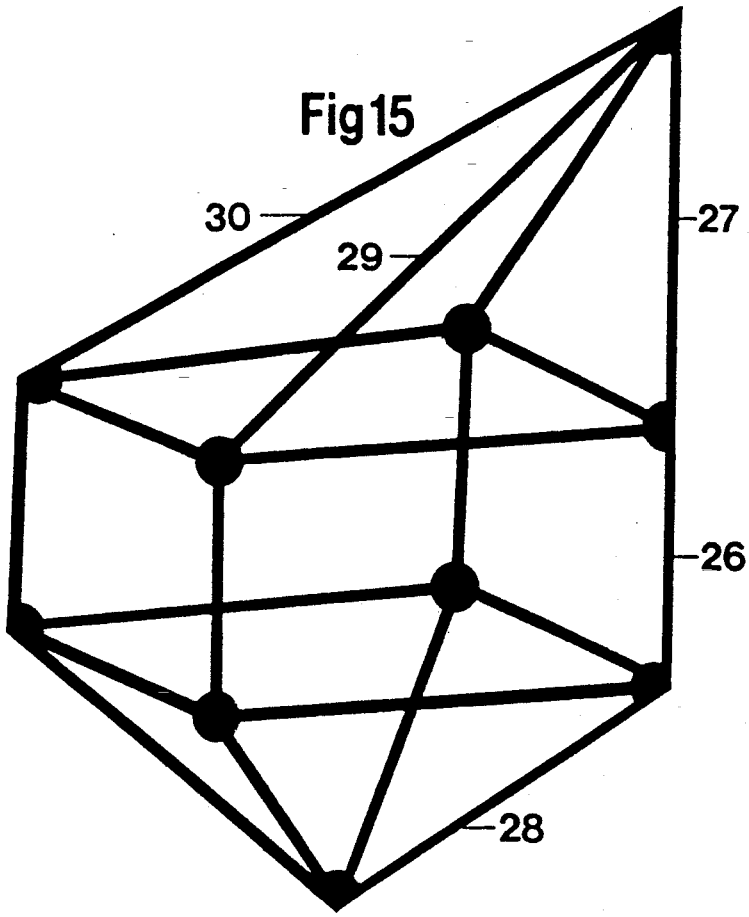

SYSTEM OF STRUCTURAL FORM BODIES

BACKGROUND OF THE INVENTION

The invention relates to a system of form bodies for use as toy building blocks, decorative objects, in particular for display use, furniture structures, sculptural building components etc., in which each form body has the shape of a polyhedron, in which polygonal side faces with each other form polyhedral outward extending protuberances and/or polyhedral inward extending recesses for assembling differently shaped bodies into spatial structures.

Such systems or building kits of geometrical form bodies are known, e.g. from DE-C-601 533, DE-A-1 907 044, DE-A-2 207 676 and from U.S. Pat. Nos. 1,292,188, 2,440,836, 3,787,996 and 4,051,621.

The disclosure of various of said references deals with systems in which the form bodies are shaped as or include pyramidal modules. Thus, DE-A-1 907 044 discloses a form body composed of two pyramidal bodies hingedly connected along an edge and DE-A-2 207 676 discloses the design of pyramidal hollow bodies by folding comparatively stiff cardboard blanks.

SUMMARY OF THE INVENTION

The invention provides for obtaining a system of form bodies of the above type that is characterized in that each form body in a first group of form bodies is shaped on the basis of a cube and that protuberances and/or recesses in the form body are shaped on the basis of a subbody of a cube and with a shape like a pyramid with a square base, two of the lateral faces being perpendicular to the base at adjacent sides thereof and each of them having the form of an isosceles right triangle.

The subbody indicated as a basis of the protuberances or recesses is obtained as a subbody of a geometric cube with a base corresponding to a side face of the cube and a pyramid apex positioned at one of the vertices of the opposite lateral face of the cube and with edges extending from said vertex to each of the vertices of the base.

Any cube may be divided into three such pyramidal subbodies with a common apex at one of the vertices of the cube and with the diagonally opposed vertex point as a common zero point for the three mutually orthogonal side faces forming the base in a respective one of the three subbodies.

Since, moreover, any cube may be divided into smaller partial cubes, each with a lateral length corresponding to half the lateral length of the initial cube, thereby forming $2^3=8$ partial cubes, any of said partial cubes may also be divided into three pyramidal subbodies, i.e. the initial cube into 24 such subbodies.

Each of said 8 partial cubes may still be divided into further 8 smaller partial cubes having a lateral length corresponding to one fourth of the initial cube then accommodating $4^3=64$ such smaller partial cubes, each of which again accommodates 3 pyramidal subbodies corresponding in total to 192 subbodies.

As it also appears from the following description with reference to the drawings, an infinite number of different form bodies may be provided from the basic module by multiplication of a common smallest basic module. The form bodies may be equipped with outward extending protuberances and inward extending recesses which likewise appear as multiples of the common basic module.

In view of the fact that the shape of the basic module is determined by a single lateral length corresponding to the lateral length of the cube of which the basic module constitues a subbody, the form bodies and their protuberances and/or recesses may include subbodies in the form of multiples of a common basic module.

Moreover, a system of form bodies according to the invention may include a second group of form bodies, of which each form body is shaped on the basis of a prism with a base as an equilateral triangle and adapted to the form bodies in the first group, in that the base has the same lateral length and the prismatic body the same height as the cube used as the basis of form bodies in the first group, protuberances and/or notches being shaped as pyramids with a base constituted by one of the opposite end faces of the prism.

Such a system may further comprise a third group of form bodies, in which each form body is shaped on the basis of a prism with a base as an isosceles right triangle and adapted to the form bodies of the first and/or second group, in that the catheti of the base and the height of the prismatic body correspond to the lateral length of the cube used as the basis of form bodies in the first group and the lateral length of the base of the prism used as the basis of the form bodies in the second group, respectively, protuberances and/or notches being shaped as pyramids with a base constituted by one of the opposite end faces of the prism.

In such form bodies with prismatic basic figures, the apex of the protuberances and/or recesses shaped as pyramids may be positioned to a normal of the base either through the geometric centre point thereof, through one of its vertices or, as regards the last mentioned design with the base as an isosceles, right triangle through the centre point of the hypotenuse of the base.

Form bodies for a system according to the invention may be manufactured as hollow bodies, for instance by folding plane blanks of cardboard or similar stiff materials. This design is appropriate in the manufacture of decorative objects for display stands, because the form bodies may be produced on site and storage and transportation is thereby facilitated.

For other purposes the form bodies may, however, be designed as solid bodies, in particular molded plastic blanks, and the form body system according to the invention of such a design is suited for the manufacture of kits of toy building blocks for children. In the production of concrete elements solid form bodies may for instance also be used in designing sculptural building components.

The form bodies may as a supplementary possibility, e.g. for decorative use in connection with display stands, be designed as grid structures of tubular elements constituting the edges of the form body and being connected by joint links constituting the vertices of the body.

Such grid structures may in a manner known per se be collapsible in that the tubular elements are hingedly connected with the joint links.

BRIEF DESCRIPTION OF THE DRAWINGS

The invention will now be explained in detail with reference to the schematical drawings, in which FIG. 14 illustrates the design of a form body by bending a plane blank, FIG. 15 shows a form body shaped as a grid structure of tubular elements.

DETAILED DESCRIPTION OF THE PREFERRED EMBODIMENTS

Figure 1:
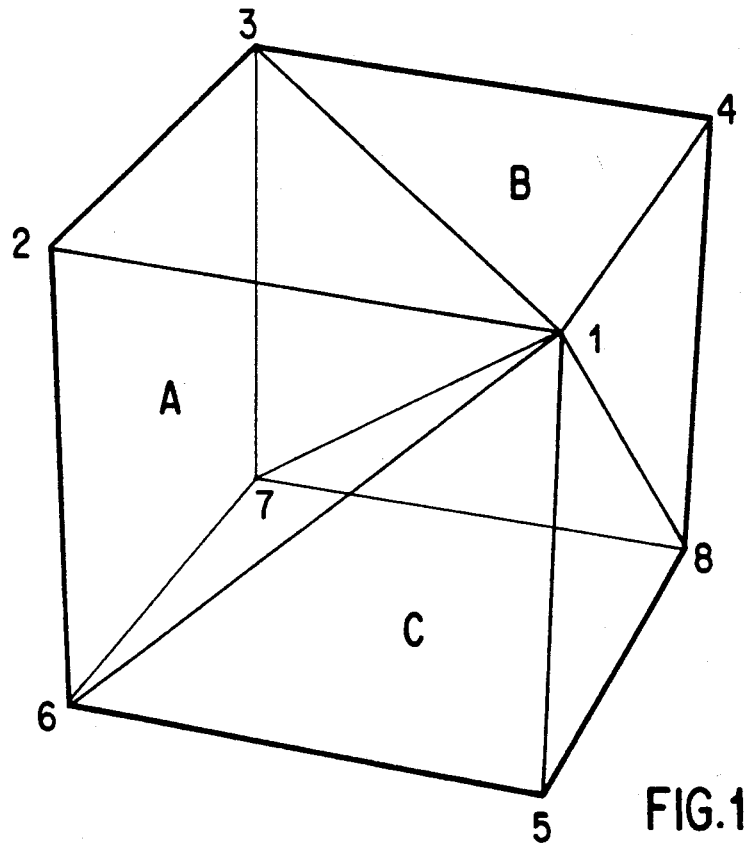
FIGS. 1 and 2 illustrate the geometric structure of a basic module for a group of form bodies in a system according to the invention.

The basic module for a first group of form bodies in a system according to the invention is obtained as illustrated in FIG. 1 by dividing a geometric cube into three uniform subbodies having the shape as a pyramid with a square base, two of the side faces being perpendicular to the base at its adjacent sides and having each the form of an isoceles, right triangle.

The vertices of the cube have the reference numerals 1 to 8 and it appears that a subbody A has its cubical side with the vertex points 2, 3, 6 and 7 as the base and its apex at the vertex point 1 that is the common apex of all three subbodies. The bases of the two other subbodies B and C are defined at the cubical sides by the vertices 3, 4, 7, 8 and 5, 6, 7, 8, respectively.

Figure 2:
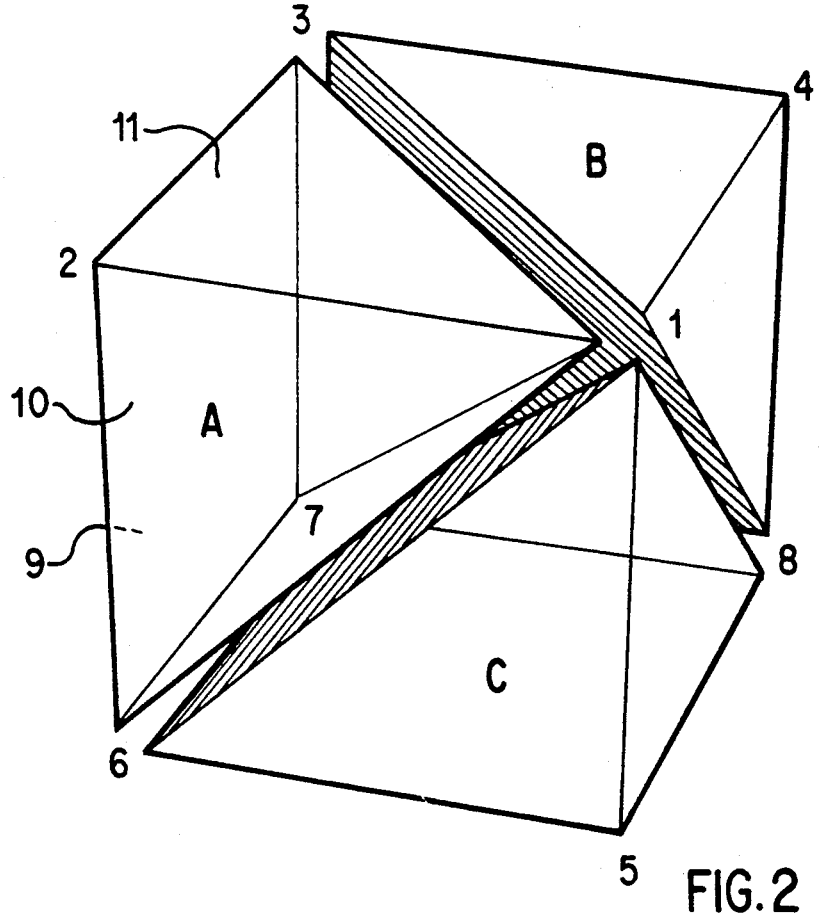

The three subbodies thus obtained are shown in a retracted mode in FIG. 2. As mentioned above and as shown for subbody A, each of said basic modules has the shape of an orthogonal pyramid with a square base 9, in which two side faces 10 and 11 are at right angles to the base at adjacent sides thereof, each having the form of an isosceles right triangle.

On the basis of said basic module an infinite number of variants of form bodies may in practice be obtained, each of which has the shape of a polyhedron, in which the polygonal side faces with each other form polyhedral outward extending protuberances and/or polyhedral inward extending recesses.

Figure 3:
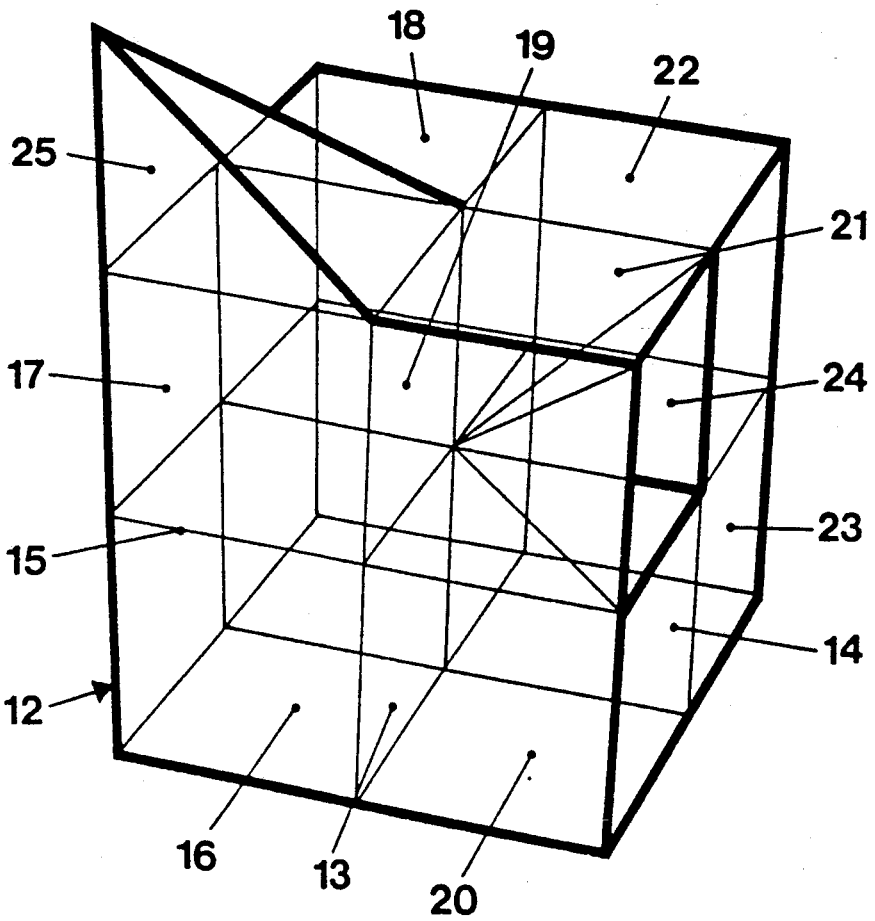
FIG. 3 illustrates the principle in designing a form body on the basis of the basic module shown in FIGS. 1 and 2, FIGS. 4 to 13 a non-exhaustive number of examples of form bodies on the basis of the basic module shown in FIGS. 1 and 2.
Figure 4:
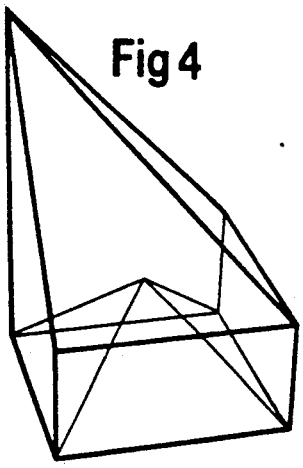
Figure 5:
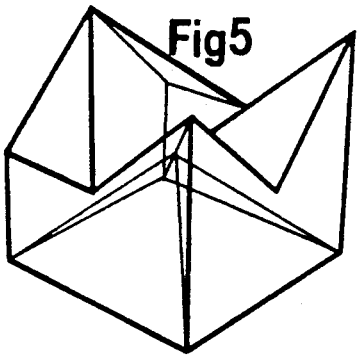
Figure 6:
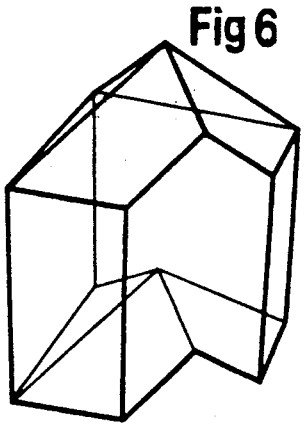
Figure 7:
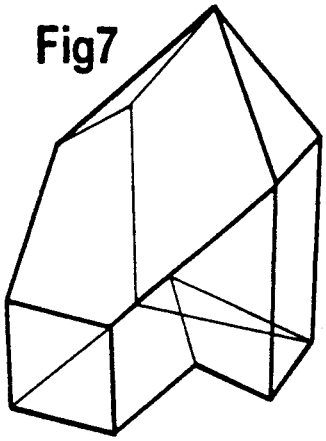
Figure 8:
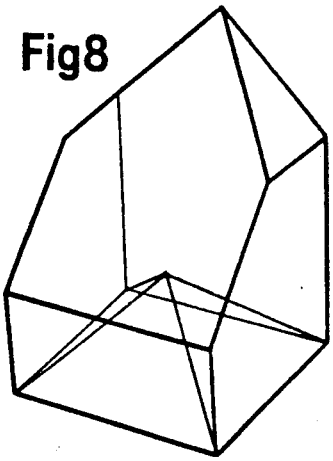
Figure 9:
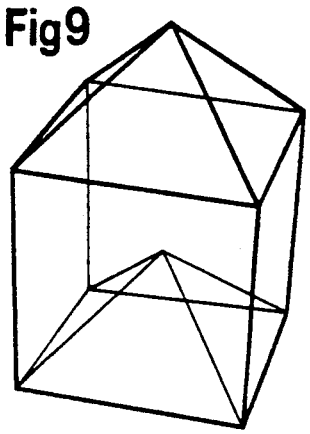
Figure 11:
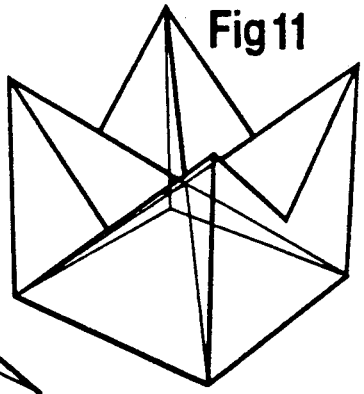
Figure 10:
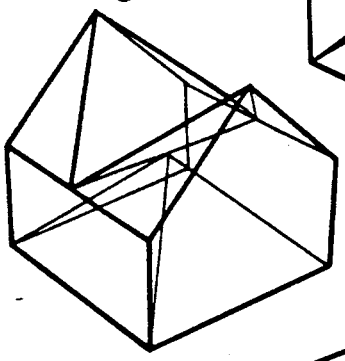
Figure 12:
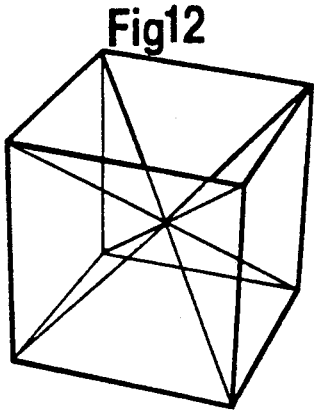
Figure 13:
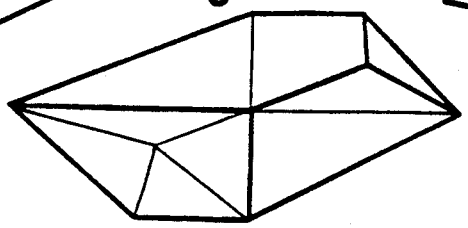

In a very simple example FIG. 3 illustrates the design of such a possible form body. The example illustrates a cube 12 which by means of three bisecting planes 13, 14 and 15 in a known manner is divided into eight partial cubes 16 to 23. In view of the fact that each of said cubes, as shown in FIG. 1, may be divided into three basic modules, it has been shown for the partial cube 21 how an inward extending recess 24 in the form body is obtained by removing a subbody corresponding to a basic module.

Moreover, as regards the partial cube 17 it has been shown how an outward extending protuberance 25 may be provided by addition of a basic module.

It will easily appear that a further development of this principle caters for an infinite number of different possibilities of designing form bodies of the first group by providing notches and/or protuberances in comparison with a basic structure in the form of a geometric cube.

FIGS. 4 to 13 show a limited, but in no way exhaustive number of examples of such form bodies, all of which are obtainable from a cubic structure.

The form bodies may be designed as hollow bodies with walls e.g. from rigid plastic material or cardboard, joined at the edges by adhesion or in any other known manner.

As illustrated in FIG. 14 the form bodies may also be obtained by bending plane blanks along folding lines, some of which constitute edges of the polyhedron defined by the form body.

For use e.g. as kits of toy building blocks for children the form bodies may also be produced as solid bodies, in particular moulded plastic blanks, and solid designs may as well be manufactured from concrete or similar building materials for use in the structure of sculptural building components.

When designing the form bodies as hollow bodies different side faces of the same form body may be given different colours and form bodies may as well be fabricated wholly or partly with transparent side faces to obtain desired light effects.

The protuberances and recesses of the form bodies may be mating, thereby allowing such mutually engaging form bodies to be combined into complex self-supporting spatial structures.

For instance for use as decorative elements on display stands and for other kinds of decoration, the form bodies may be designed as grid structures of tubular elements, e.g. aluminium tubes as illustrated in FIG. 15. The individual tubular elements 26, 27, 28, 29 and 30 have lengths corresponding to the practised sizes of modules and constitute the edges of the form body when connected in joining links. By making the connections between the tubular elements and the joining links demountable to a necessary extent, such grid structures may in a manner known per se be made collapsible.

As shown in FIGS. 16 to 19, a system of form bodies according to the invention may further include a second and/or third group of form bodies, each body being formed on the basis of a prism.

Figure 18:
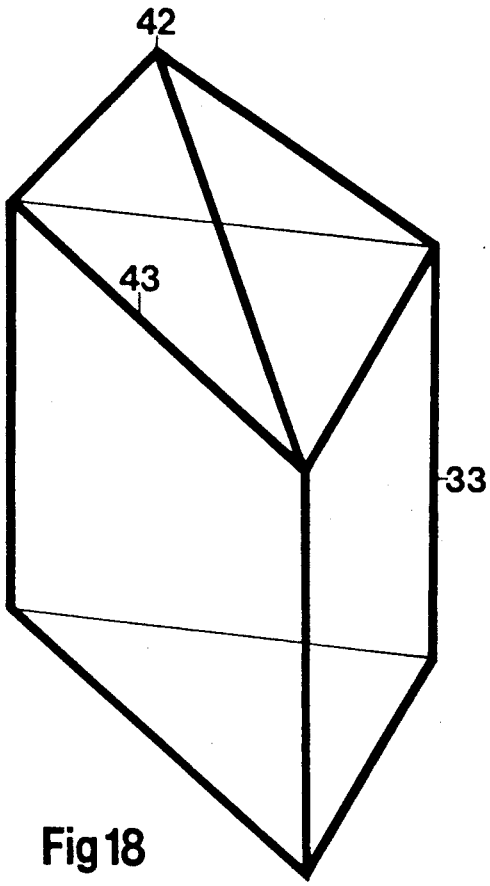
FIG. 18 is a perspective view of a form body of a third group according to the invention.
Figure 16:
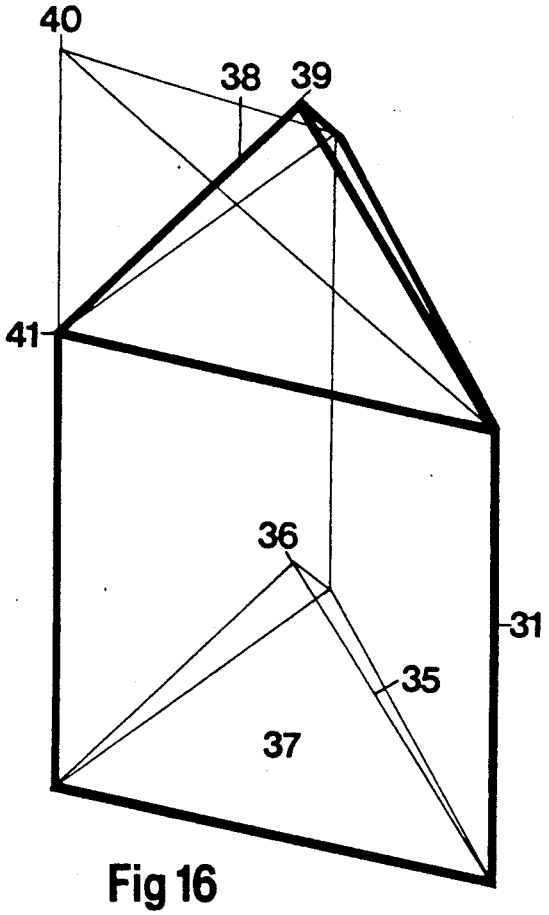
FIG. 16 is a perspective view of a form body of a second group according to the invention.
Figure 19:
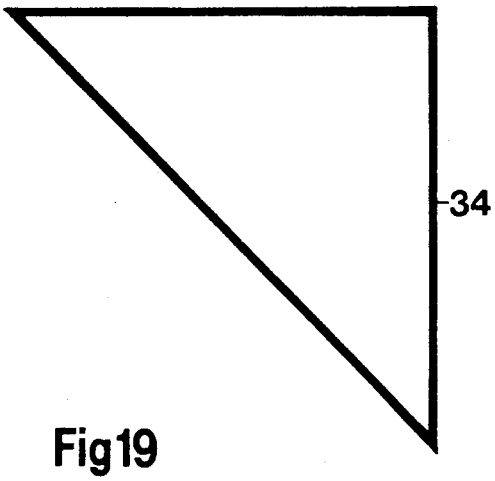
FIG. 19 is a planar view of the base of the form body shown in FIG. 18.
Figure 17:
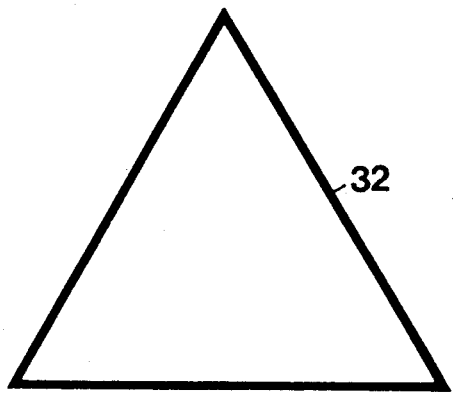
FIG. 17 is a planar view of the base of the form body shown in FIG. 16.

FIGS. 16 and 17 show an example of such a prismatic body 31 with base as an equilateral triangle 32, while FIGS. 18 and 19 show an example of a prismatic body 33 with base as an isosceles right triangle 34. Form bodies of the second and the third group within the same system of form bodies according to the invention conform to each other and to the form bodies in the first group, in that the length of the catheti of the base shaped as an equilateral triangle of form bodies in the second group and the cathetus length of the base shaped as an isosceles right triangle of form bodies in the third group, respectively, are the same as the lateral length or length of each side of the cube forming the basis of the form bodies of the first group.

In the form bodies of the second and third group there are provided protuberances and/or recesses in the form of pyramids with a base formed by the end faces of the prismatic body 31 or 33. A form body of the second group may thus, as shown in FIG. 16, have a pyramidal recess or groove 35 from the one end face with apex 36 on a normal thereto through the geometric apex 37 of the end face and, moreover, a uniform, pyramidal protuberance at the other end face. As shown the apex 40 for a pyramidal protuberance may also be positioned on a normal to the base through one of its vertices 41.

As illustrated in FIG. 18, form bodies of the third group also include pyramidal protuberances and/or recesses from the end faces of the prismatic body. The apices of such protuberances or notches may be positioned as described above concerning the form body in FIG. 16 but may also, as shown by 42, be positioned on a normal to the base through the centre point 43 of this hypotenuse.

Form bodies of the second and the third group may be mutually combined with form bodies of the first group to obtain more complicated spatial structures. As a single example it is thus possible from two uniform prismatic form bodies of the second group to obtain a prismatic form body with base as a rhomb and from two uniform form bodies of the third group to obtain a prismatic body with base in the form of a parallelogram with sides corresponding to a cathetus and the hypotenuse, respectively, of the base figure of the third group of form bodies.

In the combination with form bodies of the first group the prismatic form bodies from the second and the third group have a lateral length of the base and a height corresponding to the lateral length of the cube forming the basis of form bodies of the first group.

I claim:

1. A system of form bodies for assembling differently shaped bodies into spatial structures, in which each form body has the shape of a polyhedron having polygonal side faces which form at least one of polyhedral outward extending protuberances and polyhedral inward extending recesses, comprising:

a first group of cubically-shaped form bodies, wherein the protuberances and recesses in the form body of the first group are pyramidally-shaped with a square base and at least two isosceles right triangles orthogonally arranged with respect to each other and to said base, wherein said isosceles right triangles have catheti having a first length;

a second group of prismatically-shaped form bodies having an equilateral triangular-shaped base, said base having sides of a length equal to said first length, and each said form body of said second group having a height equal to the height of each form body of said first group, wherein the protuberances and recesses in the form body of the second group are pyramidally-shaped with a base formed by an end face of the form body of the second group; and a third group of prismatically-shaped form bodies having an isosceles right triangular-shaped base, said base having catheti having a length equal to said first length, and each said form body of said third group having a height equal to said first length, wherein the protuberances and recesses in the form body of the third group are pyramidally-shaped with a base formed by an end face of the form body of the third group;

wherein said spatial structure is formed of at least one of said groups of form bodies.

2. A system of form bodies as claimed in claim 1, wherein said form bodies and their protuberances and/or recesses include uniform modules of different size.

3. A system of form bodies as claimed in claim 1, wherein said protuberances and/or recesses in a form body of the first group extend from two opposing sides of said form body.

4. A system of form bodies as claimed in claim 1, wherein at least one of said protuberances and/or recesses in form bodies of the second and third groups are formed as pyramids having their apexes positioned on a normal to the base through its geometric center point.

5. A system of form bodies as claimed in claim 1, wherein each form body of the third group of form bodies is shaped on the basis of a prism with a base as an isosceles right triangle and adapted to the form bodies of the first and/or second group, in that the cathetus of the base and the height of the prismatic body correspond to the first length of the cube used as the basis of form bodies in the first group and the first length of the base of the prism used as the basis of the form bodies in the second group, respectively, protuberances and recesses being shaped as pyramids with a base.

6. A system of form bodies as claimed in claim 1, wherein a pyramid apex of protuberances and recesses formed as pyramids is positioned on a normal to the base through its geometric centre point.

7. A system of form bodies as claimed in claim 1, wherein two uniform form bodies of the second group are combined to form a prismatic form body having a rhombic-shaped base.

8. A system of form bodies as claimed in claim 1, wherein two uniform form bodies of the third group are combined to form a prismatic form body having a parallelogram-shaped base.

9. A system of form bodies as claimed in claim 1, wherein the form bodies are hollow bodies.

10. A system of form bodies as claimed in claim 9, wherein said form bodies are obtained by bending plane blanks along folding lines constituting the edges of the polyhedron defined by each element.

11. A system of form bodies as claimed in claim 1, wherein the form bodies are made as solid bodies.

12. A system of building elements as claimed in claim 1, wherein the form bodies are designed as grid structures of tubular elements forming edges in said polyhedrons which are connected by joining links forming vertices in the polyhedrons.

13. A system of form bodies as claimed in claim 12, wherein said grid structures gratings are collapsible, the tubular elements being hingedly connected with the joining links.

14. A system, of form bodies as claimed in claim 1, wherein said spatial structure is a spatial decorative structure in display stands.

15. A system of form bodies as claimed in claim 1, wherein said spatial structure is a kit of toy building blocks.

16. A system of form bodies as claimed in claim 1, wherein said spatial structure is a module in a modular system in the construction of architecture models of building works.

17. A system of form bodies as claimed in claim 11, wherein said solid bodies are made by molding.

* * * * *